US005690484A

United States Patent [19]

Leonard et al.

[11] Patent Number: 5,690,484

[45] Date of Patent: Nov. 25, 1997

[54] CANDLE WICK HOLDER

[75] Inventors: Stephen B. Leonard, Franksville; D. James Musiel, Wind Point, both of Wis.

[73] Assignee: S. C. Johnson & Son, Inc., Racine, Wis.

[21] Appl. No.: 628,431

[22] Filed: Apr. 5, 1996

Related U.S. Application Data

[63] Continuation-in-part of Ser. No. 592,165, Jan. 26, 1996, abandoned.

[51] Int. Cl.[6] ..... F23D 3/24

[52] U.S. Cl. ..... 431/291; 431/289; 431/288; 431/320; 248/686

[58] Field of Search ..... 431/288, 297, 431/296, 291, 320, 298; 248/579, 529, 530, 686

[56] References Cited

U.S. PATENT DOCUMENTS

| | | | |
|---|---|---|---|
| 574,376 | 1/1897 | Baumer . | |
| 1,226,850 | 5/1917 | Booty . | |
| 1,267,968 | 5/1918 | Bulle . | |
| 1,309,545 | 7/1919 | Reicher . | |
| 1,320,109 | 10/1919 | Wooster . | |
| 1,326,162 | 12/1919 | Anagnostopoulos | 248/519 |
| 1,344,446 | 6/1920 | Engman . | |
| 1,505,092 | 8/1924 | Grupe . | |
| 2,291,067 | 7/1942 | Atkins . | |
| 2,324,753 | 7/1943 | Alexiade . | |
| 3,462,235 | 8/1969 | Summers . | |
| 3,797,990 | 3/1974 | Rogers et al. . | |
| 3,998,922 | 12/1976 | Weiss . | |
| 4,381,914 | 5/1983 | Ferguson . | |
| 4,839,144 | 6/1989 | Martin . | |
| 5,090,656 | 2/1992 | Brown | 248/530 |

FOREIGN PATENT DOCUMENTS

| | | | |
|---|---|---|---|
| 153227 | 8/1903 | Germany | 431/296 |

*Primary Examiner*—Carl D. Price

[57] ABSTRACT

A wick holder is disclosed, along with blanks for forming it, candles that incorporate it, and methods for making it. The wick holder has platforms for supporting the bottom of the wick and side peripheral guides. It also has leg panels to center the wick in the candle.

17 Claims, 2 Drawing Sheets

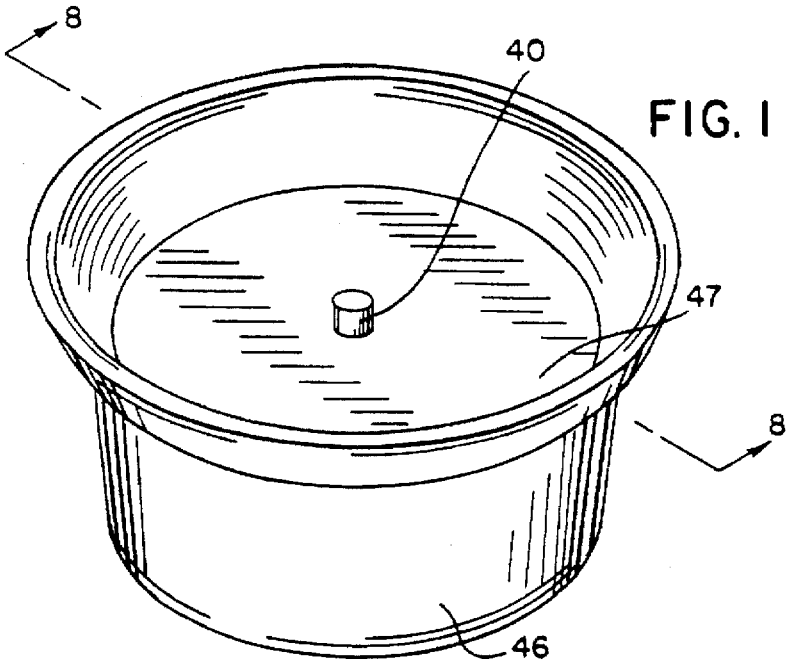
FIG. 1
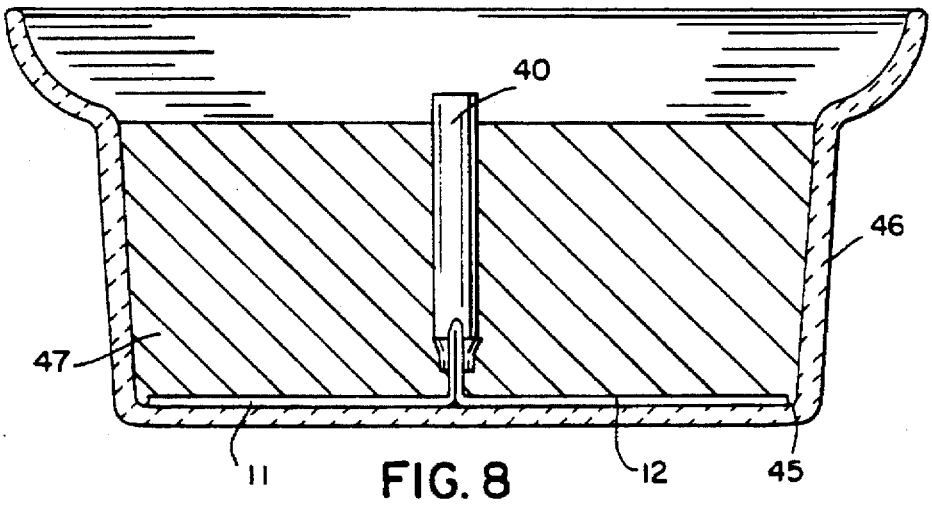
FIG. 8
FIG. 9
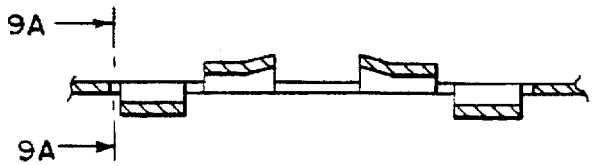
FIG. 9A
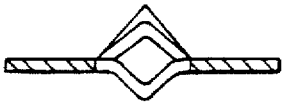

10
12
14
36
25
23
26
16
30
24
19
35
31
18
21
15
13
20
34
11

26
16
12
21
15
11

26
25
21
20

10
25
26
21
20
4A
4A 21
20

26
20
51
25
21
50

5A
48
47
5A 41
42
40

CANDLE WICK HOLDER

This is a continuation-in-part of U.S. patent application Ser. No. 08/592,165, filed 26 Jan. 1996 now abandoned.

TECHNICAL FIELD

The present invention relates to candles for dispensing materials such as insect repellents, insecticides, fumigants, fragrances, deodorants, or the like. More particularly, it relates to a wick holder for use with such candles.

BACKGROUND ART

Candles have been used as a source of light for centuries. For many years they have also been used to dispense materials into the atmosphere at a relatively constant rate. For example, it is well known that citronella oil can be dispersed in candle wax such that when the candle is lit fumes will be dispensed into the air. The fumes can repel insects.

There have been various improvements in the design of wicks and wick holding structures. A preferred wick for use with such candles is a cotton fiber wick that has been coated with a narrow cylinder of paraffin or other candle wax. An important consideration when using such wicks is that the wicks should be kept from tipping. A variety of wick holders have been designed for this purpose. See U.S. Pat. Nos. 1,226,850; 1,267,968; 1,309,545; 1,320,109; 1,344,446; 1,505,092; 2,291,067; 2,324,753; 3,462,235; 3,998,922; and 4,381,914. The disclosure of these patents, and of all other publications referred to herein, are incorporated by reference as if fully set forth herein.

Another design consideration is that when bits of carbon from the wick (or an igniting match) collect in the wax, near the bottom of the candle, the candle can flareup as the candle reaches its end. See U.S. Pat. No. 3,797,990. For this reason, some prior art wick holders support the wick somewhat above the bottom of a candle pot and/or have structures that cut-off oxygen to the wick above the bottom.

However, certain wick holders do not provide a good mechanism for positioning the wick centrally in the candle, or suffer from other problems. For example, some hold the wick using tabs that are supported at only one end. These tabs can be difficult to position quickly and securely.

Other wick holders are deficient in that they must be, in significant part, assembled manually (and/or they interfit with the wick manually). Manual assembly can be labor intensive, unduly expensive and time consuming. Moreover, some assembly protocols require a twisting motion which can cause repetitive strain injuries.

Yet another problem is that some prior art wick holders do not permit the bottom of the wick to be adequately exposed to wax. This can lead to poor burning characteristics in some cases.

Thus, it can be seen that a need exists for an improved wick holder.

DISCLOSURE OF THE INVENTION

In one aspect, the invention provides a foldable blank for use in forming a candle wick holder. There is an elongated sheet of foldable material having a first leg panel. A first wick support panel is connected to the first leg panel and has an inwardly bendable platform portion and an outwardly bendable wick guide portion. There is also a second wick support panel connected to the first wick support panel at an opposite end of the first wick support panel from the first leg panel. The second wick support panel also has an inwardly bendable platform portion and an outwardly bendable wick guide portion. There is also a second leg panel.

In a preferred form, the blank is generally rectangular and at least one of the first and second support panels has at least three cut-outs, with a platform portion being between a first and a second of the cut-outs and a guide portion being between the second and a third of the cut-outs.

The legs are preferably of essentially identical length, the blank can be made of metal such as steel, and both of the first and second support panels can have at least three cut-outs (with one of the cut-outs through the first support panel being integrated with one of the cut-outs through the second support panel so as to form an essentially square central cut-out region through the blank).

In another form the invention provides a candle wick holder. The holder has a first leg panel. There is also and a first wick support panel connected to the first leg panel and having an inwardly directed platform portion and an outwardly directed wick guide portion that is higher on the first wick support panel than the platform portion is. There is also a second wick support panel connected to the first wick support panel at an opposite end of the first wick support panel from the first leg panel. The second wick support panel also has an inwardly directed platform portion and an outwardly directed wick guide portion that is higher on the second wick support panel than the platform portion is. There is also a second leg panel.

At least one of the first and second support panels can have at least three cutouts, with a platform portion being between a first and a second of the cut-outs and a guide portion being between the second and a third of the cut-outs. The legs can be of essentially identical length and extend essentially horizontally.

In an especially preferred form platforms on the first and second panels each have a top surface that is at substantially the same height and the platforms are positioned adjacent to each other. They are suitable to support a wick while permitting wax to contact the bottom of the wick. Guides on the first and second panels are at preferably substantially the same height so as to (together) provide a peripheral wick guide.

In yet another form the present invention provides a candle. A wick is inserted in a wick holder of the above kind (between the first and second panels of the wick holder so as to be supported above the legs of the wick holder and in an essentially vertical manner). Wax surrounds at least a portion of the wick. If desired, citronella oil or another insect repellent, insecticide, fragrance, or fumigant can be present in the wax.

In still another embodiment the invention provides a method of manufacturing a combined wick holder and wick. One folds the above blank to a first intermediate assembly position, inserts a wick between the first and second support panels thereof, and then continues to fold the blank until the guide portions are in contact with a peripheral surface of the wick.

The objects of the present invention therefore include providing:

(a) a wick holder of the above kind which can be manufactured using automated means;

(b) a wick holder of the above kind which can be formed from inexpensive material;

(c) a wick holder of the above kind which stably supports the wick and which automatically centers the wick in the candle;

(d) a wick holder of the above kind which suppresses the tendency of the candle to flare as the wick nears its end;

(e) blanks of the above kind for producing such wick holders;

(f) candles of the above kind that use such wick holders, especially where the candle contains an insect repellent; and (g) methods of producing such candle holders. These and still other objects and advantages of the present invention will be apparent from the descriptions which follows. The following descriptions are merely of the preferred embodiments.

BRIEF DESCRIPTION OF THE DRAWINGS

FIG. 1 is a perspective view of a candle of the present invention;

FIG. 8 is a sectional view taken on line 8—8 of FIG. 1;

FIG. 9 is a cross sectional view of a second embodiment of the blank, similar to FIG. 4 but with the bends being in a different shape, and FIG. 9A is a view similar to FIG. 4A, but of the second embodiment.

BEST MODES FOR CARRYING OUT THE INVENTION

Figures 2, 3, 4, 4A, 5, 5A, 6, 7:
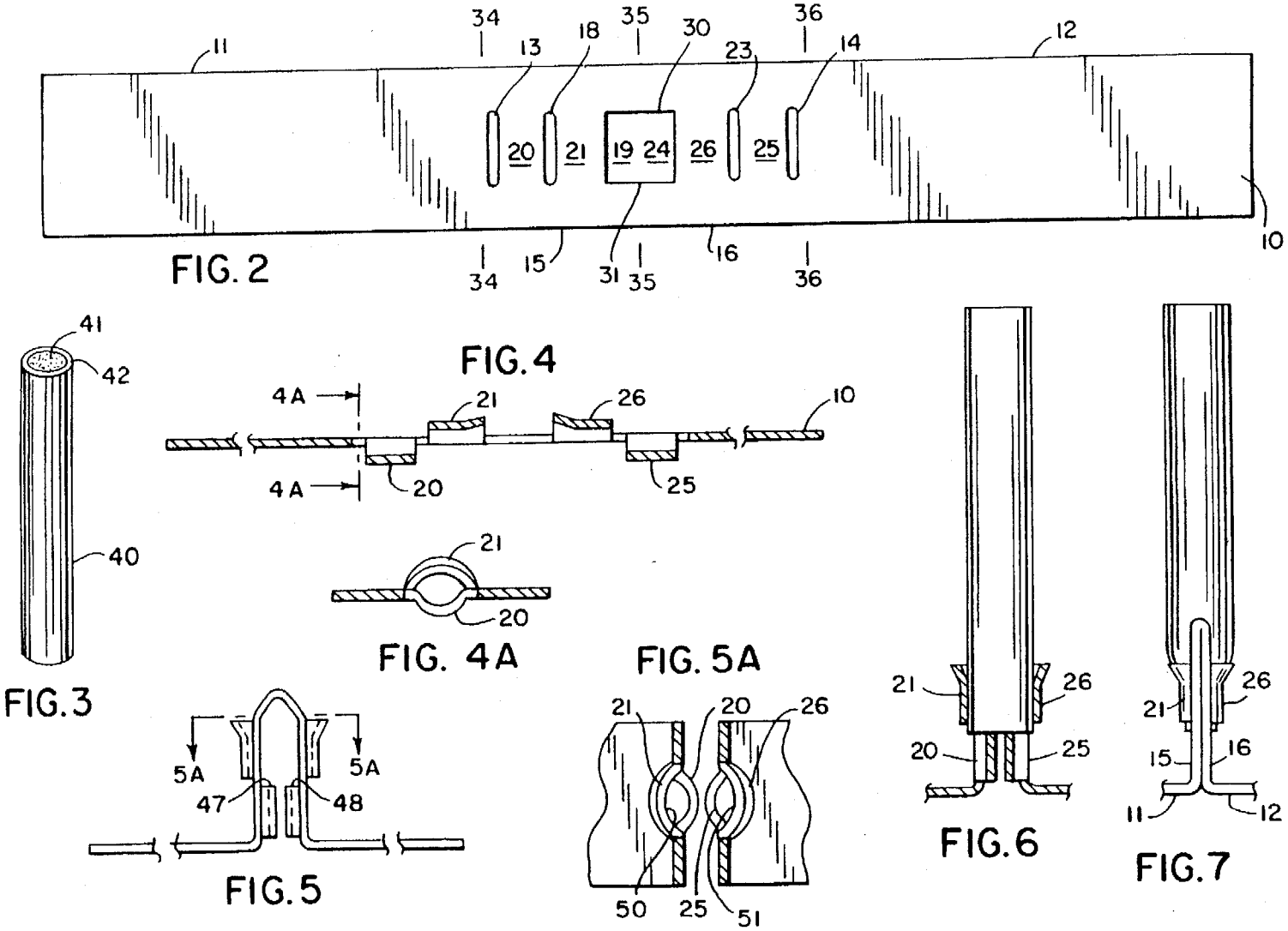
FIG. 2 is a top plan view of a blank of the present invention, with cut-outs.
FIG. 3 is a perspective view of a wick of the present invention.
FIG. 4 is a cross sectional view of the FIG. 2 blank, albeit after the blank has had two of its regions pressed in one direction and two others pressed in the opposite direction.
FIG. 4A is a sectional view taken on line 4A—4A of FIG. 4.
FIG. 5 is a side elevational view (partially truncated) of the FIG. 4 blank, albeit after it has been bent to a first assembly position.
FIG. 5A is a partial sectional view taken on line 5A—5A of FIG. 5.
FIG. 6 is a cross sectional view of the FIG. 5 structure, albeit with a wick inserted between the support panels.
FIG. 7 is a side elevational view after the holder has been bent to its final position.

One preferred blank (generally 10) of the present invention can best be understood by reviewing FIGS. 2, 4 and 7. It is made from a thin (e.g. ⅛ inch) stainless steel metal (which is about 1 inch by 5 inches).

There are two leg panels 11, 12 which are of the same length. They thereby provide for automatic centering of the wick holder. These legs end at the longitudinal axis of cut-outs 13, 14. There are two support panels 15, 16 which extend from the legs to the center line of the blank.

Panel 15 has two additional cut-outs 18, 19. Cut-out 19 is one-half of a square cut-out in the middle of the blank. Between the longitudinal axis of the cut-out 13 and the longitudinal axis of cut-out 18 there is an inwardly bendable "platform" 20. Between the longitudinal axis of cut-out 18 and the center line of the blank is an outwardly bendable wick guide 21. Similarly, support panel 16 has two additional cut-outs 23 and 24. Cut-out 24 is the other half of the square cut-out in the middle of the blank. Between the longitudinal axis of the cut-out 14 and the longitudinal axis of cut-out 23 there is another inwardly bendable platform portion 25. Similarly, between the longitudinal axis of cut-out 23 and the center line of the blank is another outwardly bendable wick guide portion 26.

During the manufacturing process, we preferably begin with a flat rectangular sheet of stainless steel. We punch cut-outs through the metal. The exact shape of the cut-out holes is not critical. There should, however, be sufficient room between walls 30 and 31 of the central cut-outs for the wick to fit through. Guides 21, 26 and platforms 20, 25 are then pressed into the positions shown in FIG. 4 (or in the alternative those shown in FIG. 9).

We then fold the blank along three primary fold lines 34, 35, 36, using a machine tool. This yields the FIG. 5 structure.

As best seen in FIG. 3, there is a wick 40 having a central core of cotton rope 41 surrounded by a thin cylinder 42 of paraffin wax. A machine takes the wick and drops it into the "ring" defined by guides 21 and 26 (between the support panels 15, 16).

The platforms 20, 25 provide a limiting stop for the bottom 44 of the wick 40 so that (as best seen in FIGS. 6 and 8) they can hold the wick bottom about one-quarter of an inch up off the bottom 45 of a pot 46. The top surfaces 47, 48 of platforms 20 and 25 are at substantially the same height, thereby making it easier to support the wick in a vertical fashion.

Once the wick 40 is positioned as shown in FIG. 6, the structure is further compressed along fold line 35 by a machine to yield the FIG. 7 structure (where interior surfaces 50, 51 of the guides squeeze the wick peripheral surface). This stably and reproducibly supports the wick in a vertical manner. Moreover, it acts as an oxygen cut-off so that the wick will automatically snuff at about the top edge of the guide.

While one could dip the wick with wick holder attached into wax (and avoid the need for a pot 46), we preferably take the FIG. 7 structure and place it in a pot 46. We then partially fill the pot with a standard candle wax 47, leaving only a small portion of the wick exposed, at its top. Prior to adding the wax, colorant, insect repellent, fumigant, fragrance or the like are preferably uniformly dispersed throughout the wax.

From FIG. 8 it will be appreciated that legs 11, 12 are of a size just sufficient so that they almost contact the sidewalls of the bottom of the pot 46. The legs thus provide an automatic centering system for the candle.

To use the candle, one lights the candle in the usual fashion. Citronella candles are preferably lit outdoors adjacent where humans wish to congregate (e.g. on picnic tables). Insects to be repelled can be the usual array of house and garden insects (e.g. mosquitoes, flies, cockroaches).

The assembly method of the present invention has a number of advantages. Most importantly, it can be automated. Note that providing an intermediate assembly position for inserting the wick is important in permitting a machine to insert the wick.

It should be noted that platforms 20, 25, even in the FIG. 7 position, have holes through them. Thus, the bottom of the wick is exposed to the wax at all times.

While the preferred embodiments of the present invention have been described above, many other alternatives are intended to be within the scope of the invention. For example, the blank need not be rectangular (e.g. the edges of the blank can be rounded to conform to the pot shape). Further, the blank need not be metal, albeit sheet metal is highly preferred. Also, the dimensions and shapes of the inwardly bendable regions, outwardly bendable regions, and cut-outs can vary. The claims should be therefore looked to determine the full scope of the invention.

Industrial Applicabilily

INDUSTRY APPLICABILITY

The present invention is useful in making candles, particularly those that give off insect repellents.

What is claimed is:

1. A foldable blank for use in forming a candle wick holder, comprising an elongated sheet of foldable material, the sheet having an upper surface and a downward surface, with:

a first leg panel;

a first wick support panel connected to the first leg panel and having a downwardly bendable platform panel and an upwardly bendable wick guide panel;

a second wick support panel connected to the first wick support panel at an opposite end of the first wick support panel from the first leg panel, the second support panel also having an upwardly bendable wick guide panel; and a second leg panel connected to the second wick support panel at an opposite end of the second wick support panel from the first wick support panel.

2. A method of manufacturing a combined wick holder and wick, comprising:

(a) obtaining a blank that is a elongated sheet of foldable material having an upper surface and a downward surface with:

a first leg panel;

a first wick support panel connected to the first leg panel and having a downwardly bendable platform panel and an upwardly bendable wick guide panel;

a second wick support panel connected to the first wick support panel at an opposite end of the first wick support panel from the first leg panel, the second wick support panel also having a downwardly bendable platform panel and an upwardly bendable wick guide panel; and a second leg panel connected to the second wick support panel at an opposite end of the second wick support panel from the first wick support panel;

(b) folding the blank to a first immediate position;

(c) inserting a wick between the first and second support panels; and (d) thereafter continuing to fold the blank to form a holder and to retain the wick in a holder, the holder comprising:

a first holder leg;

a first holder wick support connected to the first holder leg and having a radially inwardly directed holder platform and a radially outwardly directed holder wick guide higher on the first holder wick support than the holder platform;

a second holder wick support connected to the first holder wick support at an opposite end of the first holder wick support from the first holder leg, the second holder wick support also having a radially inwardly directed holder platform and a radially outwardly directed holder wick guide higher on the second holder wick support than the holder platform; and a second holder leg connected to the second holder wick support at an opposite end of the second holder wick support from the first holder wick support.

3. A foldable blank for use in forming a candle wick holder, comprising an elongated sheet of foldable material, the sheet having an upper surface and a downwold surface, with:

a first leg panel;

a first wick support panel connected to the first leg panel and having a downwardly bendable platform panel and an upwardly bendable wick guide panel;

a second wick support panel connected to the first wick support panel at an opposite end of the first wick support panel from the first leg panel, the second wick support panel also having a downwardly bendable platform panel and an upwardly bendable wick guide panel; and a second leg panel connected to the second wick support panel at an opposite end of the second wick support panel from the first wick support panel:

wherein at least one of the first and second support panels have at least three cut-outs. with a panel portion being between a first and a second of the cut-outs and guide panel being between the second and a third of the cut-outs.

4. The blank of claim 1, wherein the leg panels are of essentially identical length.

5. The blank of claim 1, wherein blank is made of metal.

6. The blank of claim 1, wherein each of the first and second support panels have at least three cut-outs, with one of the cut-outs through the first support panel being integrated with one of the cut-outs through the second support panel so as to form an essentially square central cut-out region through the blank.

7. A candle wick holder, comprising:

a first leg panel;

a first wick support panel connected to the first leg panel and having a radially inwardly directed platform panel and a radially outwardly directed wick guide panel higher on the first wick support panel than the platform;

a second wick support panel connected to the first wick support panel at an opposite end of the first wick support panel from the first leg panel, the second wick support panel also having a radially inwardly directed platform and a radially outwardly directed wick guide higher on the second wick support panel than the platform; and a second leg panel connected to the second wick support panel at an opposite end of the second wick support panel from the first wick support panel;

wherein at least one of the first and second support panels have at least three cut-outs, with a platform being between a first and a second of the cut-out and a guide being between the second and a third of the cut-outs.

8. The holder of claim 7, wherein the leg panels are of essentially identical length and are both essentially horizontal.

9. The holder of claim 7, wherein the holder is made of metal.

10. The holder of claim 7, wherein each of the first and second support panels have at least three cut-outs with one of the cut-outs through the first support panel being integrated with one of the cut-outs through the second support panel so as to form an essentially square central cut-out region through the blank.

11. The holder of claim 10, wherein the platforms on the first and second panels each have a top surface that is at substantially the same height and the platforms are positioned adjacent to each other.

12. The holder of claim 10, wherein the guides on the first and second panels each are at substantially the same height so as to provide a peripheral wick guide.

13. The holder of claim 12, wherein the peripheral wick guide has two arc like regions.

14. A candle, comprising:

the wick holder of claim 7;

a wick inserted in the wick holder between the first and second panels of said wick holder so as to be supported above the leg panels of the wick holder and in an essentially vertical manner; and wax surrounding at least a portion of the wick.

15. The candle of claim 14, wherein an insect repellent is present in the wax.

16. The candle of claim 15, wherein citronella oil is present in the wax.

17. The candle of claim 16, wherein the candle is positioned in a pot and the leg panels assist in centering the wick along a vertical central axis of the pot.

* * * * *

UNITED STATES PATENT AND TRADEMARK OFFICE

CERTIFICATE OF CORRECTION

PATENT NO. : 5,690,484
DATED : November 25, 1997
INVENTOR(S) : Stephen B. Leonard and James Musiel It is certified that error appears in the above-identified patent and that said Letters Patent is hereby corrected as shown below:

Column 5, line 20, insert the word "wick" after second, and before support.

Column 5, line 21, Before- An upwardly Bendable wick Guide Panel insert-A downwardly Benadable Platform Panel; and Signed and Sealed this Twenty-eighth Day of November, 2000

*Attest:*

*Attesting Officer*

Q. TODD DICKINSON

*Director of Patents and Trademarks*